US012305463B2

(12) United States Patent
Javed et al.

(10) Patent No.: US 12,305,463 B2
(45) Date of Patent: May 20, 2025

(54) METHODS AND APPARATUS FOR RETRIEVING A WIRELINE USING A RELEASE SUB

(71) Applicant: SAUDI ARABIAN OIL COMPANY, Dhahran (SA)

(72) Inventors: Muhammad Imran Javed, Abqaiq (SA); Akram R. Al-Barghouti, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/495,252

(22) Filed: Oct. 26, 2023

(65) Prior Publication Data

US 2025/0137339 A1 May 1, 2025

(51) Int. Cl.
*E21B 23/00* (2006.01)
*E21B 31/113* (2006.01)
*E21B 31/12* (2006.01)

(52) U.S. Cl.
CPC ..... *E21B 31/125* (2013.01); *E21B 23/00* (2013.01); *E21B 31/113* (2013.01)

(58) Field of Classification Search
CPC ..... E21B 23/00; E21B 31/113; E21B 31/107; E21B 31/125; E21B 19/166; E21B 17/06; Y10S 411/416; Y10T 285/922; F16B 31/021; F16B 31/027
USPC ..... 411/4
See application file for complete search history.

(56) References Cited

U.S. PATENT DOCUMENTS 2,399,766 A * 5/1946 Steward ..... E21B 33/1293 166/134
3,353,847 A * 11/1967 Brown ..... F16L 37/002 285/321
3,618,177 A * 11/1971 Wood ..... E21B 31/00 166/117.7

(Continued)

FOREIGN PATENT DOCUMENTS

GB 2538358 A 11/2016
WO 2023187458 A1 10/2023

OTHER PUBLICATIONS

Hossain, M.E. et al., "Drilling Engineering Problems and Solutions: A Field Guide for Engineers and Students," Scrivener Publishing, 2018 (626 pages).

(Continued)

*Primary Examiner* — Kenneth L Thompson
(74) *Attorney, Agent, or Firm* — Osha Bergman Watanabe & Burton LLP

(57) ABSTRACT

Methods, devices, and systems are discussed. In some cases, the methods may include conveying a downhole tool into a wellbore. The downhole tool includes a release sub disposed between a first section of the downhole tool and a second section of the downhole tool. The release sub includes: a first portion including a threaded pin and an electric motor, and a second portion including a threaded box where the threaded pin is threaded into the threaded box to couple the first portion to the second portion. The methods may further include causing the electric motor to rotate the threaded pin relative to the threaded box to decouple the first portion from the second portion, such that the first section of the downhole tool is at least partially detached from the second section of the downhole tool.

18 Claims, 5 Drawing Sheets

(56) References Cited

U.S. PATENT DOCUMENTS

| | | | | |
|---|---|---|---|---|
| 3,851,714 | A * | 12/1974 | Visser | E21B 19/167 173/164 |
| 4,884,632 | A | 12/1989 | Rankin | |
| 5,303,776 | A * | 4/1994 | Ryan | E21B 33/129 175/269 |
| 5,404,944 | A * | 4/1995 | Lynde | E21B 23/0411 166/117.7 |
| 6,712,146 | B2 | 3/2004 | Estep et al. | |
| 7,559,364 | B2 * | 7/2009 | Bullard | E21B 23/06 166/187 |
| 7,779,924 | B2 * | 8/2010 | Clamens | E21B 33/124 166/387 |
| 7,980,310 | B2 * | 7/2011 | Stoesz | E21B 17/06 166/299 |
| 8,230,932 | B2 | 7/2012 | Ratcliffe et al. | |
| 10,370,907 | B2 * | 8/2019 | Ollerenshaw | E21B 17/06 |
| 11,136,866 | B2 * | 10/2021 | Holodnak | E21B 23/14 |
| 2008/0202767 | A1 | 8/2008 | Sheiretov et al. | |
| 2011/0259601 | A1 | 10/2011 | Withers | |
| 2014/0285204 | A1 | 9/2014 | Okonkwo et al. | |
| 2014/0285205 | A1 | 9/2014 | Okonkwo et al. | |

OTHER PUBLICATIONS

Degeare, J. "The Guide to Oilwell Fishing Operations," Elsevier Inc., pp. 111-115, 2015 (5 pages).

International Search Report and Written Opinion issued in corresponding International Application No. PCT/US2024/0051787, dated Dec. 18, 2024 (14 pages).

* cited by examiner

METHODS AND APPARATUS FOR RETRIEVING A WIRELINE USING A RELEASE SUB

BACKGROUND

An e-line or wireline may be attached to a connector at the top of a downhole tool that is deployed into a wellbore. Such a wireline includes an electrical conductor used for transmitting electrical current from the surface to tools deployed in a wellbore, and as such the wireline both physically and electrically connects the downhole tool to the surface. Occasionally a downhole tool deployed in a wellbore gets stuck. Once stuck an onsite engineer would typically perform various tasks to release the downhole tool and bring it back to surface. If the efforts fail to release the tool, the onsite engineer may perform an overpull on the wireline causing it to break at a weak point. This is both unsafe and can result in, inter alia, complications to the wellbore.

There is a need in the art for methods and systems for retrieving downhole tools and wirelines from a wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, some embodiments relate to methods including conveying a downhole tool into a wellbore. The downhole tool includes a release sub disposed between a first section of the downhole tool and a second section of the downhole tool. The the release sub includes: a first portion including a threaded pin and an electric motor, and a second portion including a threaded box where the threaded pin is threaded into the threaded box to couple the first portion to the second portion. The methods further include causing the electric motor to rotate the threaded pin relative to the threaded box to decouple the first portion from the second portion, such that the first section of the downhole tool is at least partially detached from the second section of the downhole tool.

In general, in one aspect, various embodiments relate to a downhole tool device including a release sub attachable between a first section of a downhole tool and a second section of the downhole tool and configured to detach the first section of the downhole tool from the second section of the downhole tool. The release sub includes: a first portion including a threaded pin and an electric motor, and a second portion including threaded box where the threaded pin is threaded into the threaded box to couple the first portion to the second portion.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. In some instances, a sub-label consisting of a lower-case letter is associated with a reference numeral to denote one of multiple similar components. When reference is made to a reference numeral without specification to an existing sub-label, it is intended to refer to all such multiple similar components.

DETAILED DESCRIPTION

Figure 1:
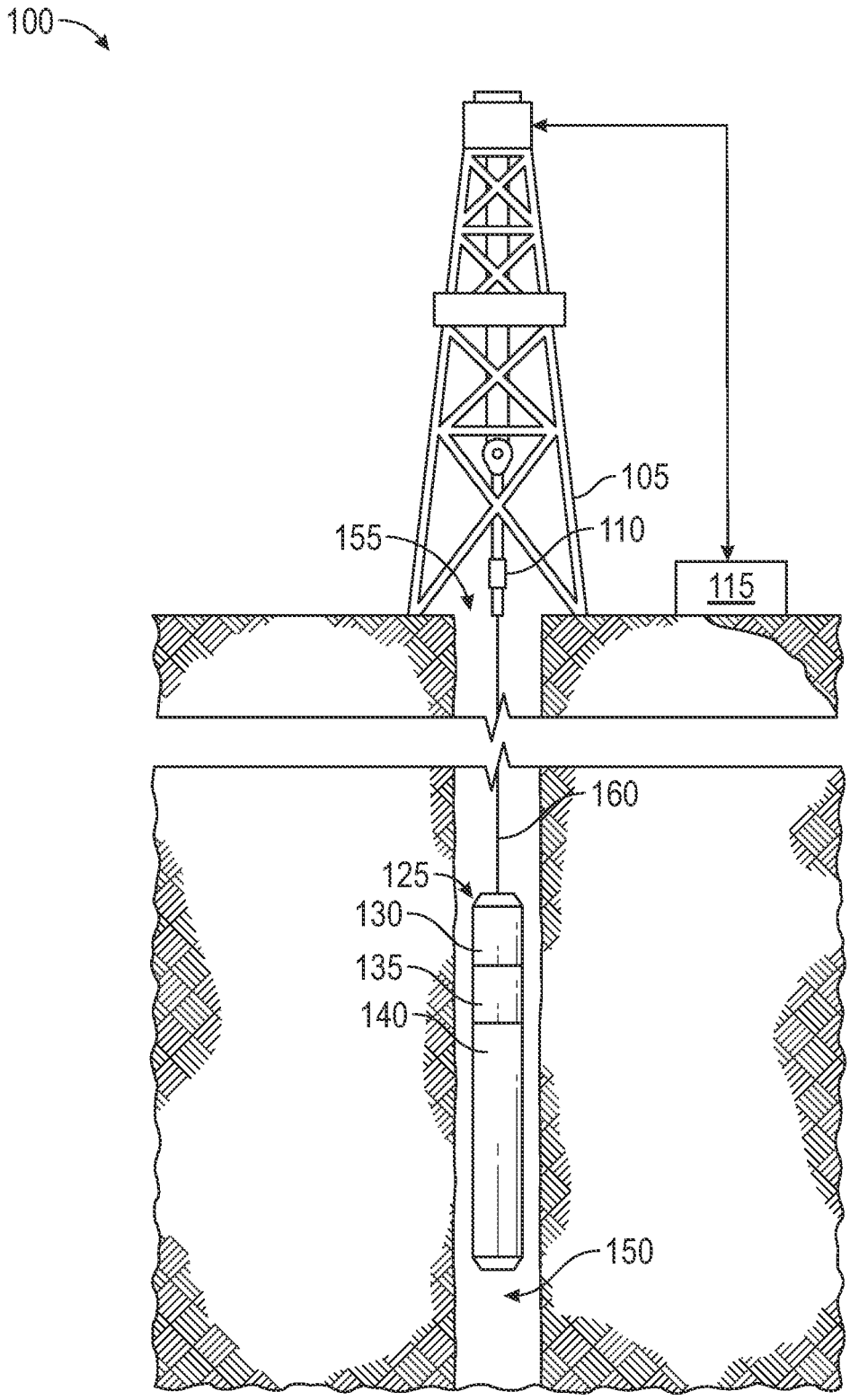
FIG. 1 illustrates a rig conveying a downhole tool having a release sub into a wellbore in accordance with some embodiments.

Various embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "cell" includes reference to one or more of such cells.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the elements shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-5, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Turning to FIG. 1, a rig 105 conveying a downhole tool 125 into a wellbore 150 is shown. Downhole tool 125 includes a release sub 135 disposed between a first section 130 and a second section 140 of downhole tool 125 in accordance with some embodiments. Downhole tool 125 is deployed through a wellbore opening 155 and extends by a wireline 160 from rig 105 into wellbore 150. While downhole tool 125 is shown as deployed by rig 105, one of ordinary skill in the art will appreciate that downhole tool may also be deployed from, for example, a truck or other suitable deployment platform. In yet other embodiments, the downhole tool can be deployed rig-less.

As is known in the art, wireline 160 may be a braided line with an electric conductor through which electrical current can be supplied to downhole tool 125. Different types of wirelines provide different tensile strengths and current carrying capacities. As one example, a five sixteenth (5/16) inch wireline offering a minimum breaking strength of eight thousand, five hundred, twenty (8520) pounds and a safe load of one thousand, seven hundred (1700) pounds may be used in relation to some embodiments. Based upon the disclosure provided herein, one of ordinary skill in the art will recognize different types of wirelines that may be used in relation to different embodiments depending upon the particular implementation.

Wireline 160 is connected to a multi-conductor cable 110. Multi-conductor cable 110 carries control and data signals between downhole tool 125 and a controller 115. Controller 115 may be any device or system capable pf providing control signals to downhole tool 125, receiving data signals from downhole tool 125, and controlling application of power signals to downhole tool 125. In some embodiments, controller 115 includes a computer processor coupled to a computer readable medium. The computer readable medium both stores data received from downhole tool 125 and includes instructions executable by the processor to control downhole tool 125. Based upon the disclosure provided herein, one of ordinary skill in the art will recognize a variety of control systems and/or computer systems that may be used to implement controller 115 in accordance with different embodiments.

In operation, downhole tool 125 is conveyed into wellbore 150. At times during the conveyance downhole tool 125 may become stuck in wellbore 150. Downhole tool 125 may become stuck for a number of reasons including, but not limited to, conditions of wellbore 150 and/or a condition of downhole tool 125. In many cases, simply pulling on wireline 160 with force substantially less than the rated strength of wireline 160 is sufficient to unstick downhole tool 125. Further, an onsite engineer may perform one or more other tasks designed to release downhole tool 125 in a way that does not significantly damage either wellbore 150 or downhole tool 125. However, in some cases downhole tool 125 may become stuck in a way that cannot be resolved without damage that may include, for example, leaving a substantial portion of wireline 160 in wellbore 150. Of note, while FIG. 1 shows an open hole, the same approach and apparatus may be applied to a cased hole.

In accordance with some embodiments, release sub 135 includes a first portion attached to first section 130 and a second portion attached to second section 140. The first portion of release sub 135 can be detached from the second portion of release sub 135, thereby physically separating first section 130 of wellbore tool 125 from second section 140 of wellbore tool 125. Where downhole tool 125 becomes stuck, the first portion of release sub 135 can be detached from the second portion of release sub 135. With first section 130 of downhole tool 125 disconnected from second section 140 of downhole tool 140, first section 130 and wireline 160 can be retrieved from wellbore 150 by pulling wireline 160. This leaves second section 140 in wellbore 150. Second section 140 may include a fish neck at the top and with first section 130 removed from wellbore 150, the fish neck is clear and easily accessed during a fishing operation where a wireline or coiled tubing is dropped from the surface down around the fish neck. This wireline or coiled tubing is substantially stronger than wireline 160 and can be used to safely pull second section 140 of downhole tool from wellbore 150 via wellbore opening 155.

In various embodiments discussed herein, a hydraulic jar is included in first section 130 of downhole tool 125 and can be used to deliver a hammering force to release sub 135. This hammering force is sufficient to shear or otherwise break shear pins that hold the first portion of release sub 135 to the second portion of release sub 135. With these shear pins sheared, an electric motor in release sub 135 causes a threaded pin in one portion of release sub 135 to rotate relative to a threaded box in the other portion of release sub 135. This rotation results in disconnecting the first portion of release sub 135 from the second portion of release sub 135. Section 130 of downhole tool 125 can then be retrieved through wellbore opening 155 separate from section 140 of downhole tool 140.

In some embodiments, the hydraulic jar is actuated by a first force pulling on wireline 160. This first force is substantially less than what wireline 160 is rated to withstand, but sufficient to actuate a hydraulic jar included in first section 130 of downhole tool 125. The hammering applied by the hydraulic jar on sub-release 135 is a second force that is greater than the first force and greater than a force required to break shear pins holding the first portion of release sub 135 to the second portion of release sub 135. As an example, wireline may be rated as one thousand, seven hundred (1700) pounds, and the first force is one thousand, four hundred (1400) pounds. Based upon the disclosure provided herein, one of ordinary skill in the art will recognize a variety of combinations of forces that may be used in relation to different embodiments to: (a) actuate the hydraulic jar, and (b) shear the shear pins. With the shear pins sheared, an electric motor in release sub 135 causes a threaded pin in one portion of release sub 135 to rotate relative to a threaded box in the other portion of release sub 135. This rotation results in disconnecting the two portions of release sub 135, and thereby disconnecting first section 130 of downhole tool 125 from second section 140 of downhole tool 140.

Figure 2A:
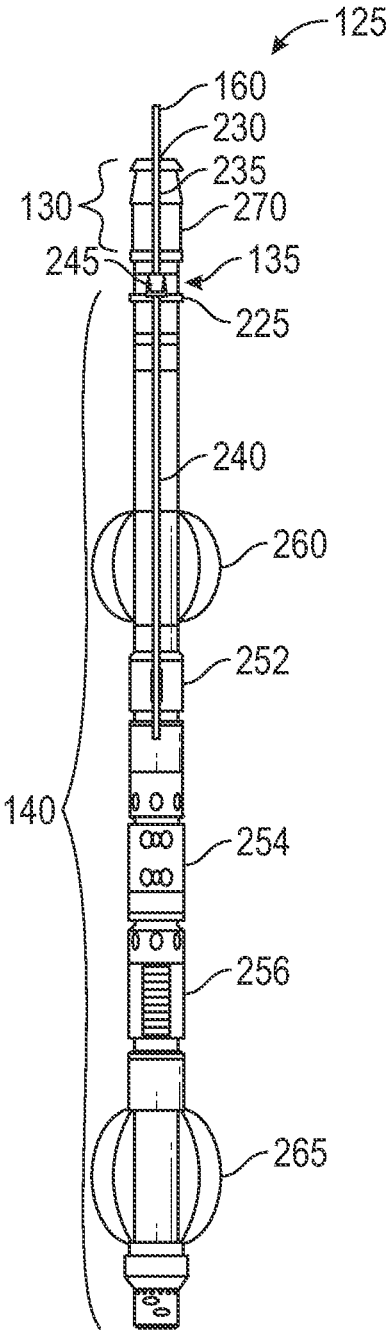
FIGS. 2A-2B show a downhole tool including a release sub in accordance with various embodiments.

Turning to FIG. 2A, an embodiment of downhole tool 125 is shown with a first portion 205 of release sub 135 connected to a second portion 215 of release sub 135. In such a condition, first section 130 is physically connected to second section 140 in such a way that downhole tool 125 operates as a unified tool extending into wellbore 150.

As shown, downhole tool 125 has a connector 230 to which wireline 160 is connected. An electrical conductor extends from wireline 160 through downhole tool 125 and provides electrical current to at least an electric motor (not shown) included in release sub 135 and one or more tools (e.g., a logging tool receiver 252, a logging tool emitter 256, and a source or sensor 254) included in second section 140 of downhole tool 125. The electrical conductor extending through downhole tool 125 includes a first conductor portion 235 and a second conductor portion 240. First conductor portion 235 is electrically connected to second conductor portion 240 by an electrical coupling 245. In some embodiments, electrical coupler 245 is disposed within release sub 135. Electrical coupler 245 may be any device known in the art for electrically connecting two conductors. While not shown, more electrical conductors may be included to provide control signals to various elements of downhole tool 125 and/or receive data signals from one or more elements of downhole tool 125 but are not shown as such is beyond the scope of this discussion.

Logging tool receiver 252 and logging tool emitter 256 may be any logging tools known in the art. Source or sensor 254 may be any type of source device or sensor device known in the art including, but not limited to, a temperature sensor, a gamma ray source, a pressure sensor, or a casing collar locator (CCL) tool. Based upon the disclosure provider herein, one of ordinary skill in the art will recognize a wide variety of logging tools, sensor tools, and/or source tools that may be incorporated in downhole tool 125. Further, while three tools are shown, one of ordinary skill in the art will appreciate that more or fewer tools may be used in relation to different embodiments.

First section 130 includes a hydraulic jar 270 that is configured to apply a hammering force on release sub 135 upon actuation. In some embodiments, actuating hydraulic jar 270 may be caused by a pulling force applied to wireline 160 that is transferred to hydraulic jar 270 via a connector 230. In some cases, hydraulic jar 270 applies a force on release sub 135 that is greater than the force applied to hydraulic jar 270 by pulling wireline 160. As such, a force applied by pulling wireline 160 that is substantially less than that for which wireline 160 is rated can be applied to hydraulic jar 270. Based upon this force, hydraulic jar 270 is activated to generate a greater force on release sub 135 than that applied by pulling wireline 160. Any type of hydraulic jar known in the art may be used in relation to different embodiments. As more fully discussed below, the amount of pressure applied to release sub 135 by hydraulic jar 270 is sufficient to shear one or more shear pins included in release sub 135.

Second section 140 includes a fish neck 225 near release sub 135. Further, second section includes two centering devices 260, 265 (i.e., centralizers) designed to maintain downhole tool 125 centered in wellbore 150.

Figure 2B:
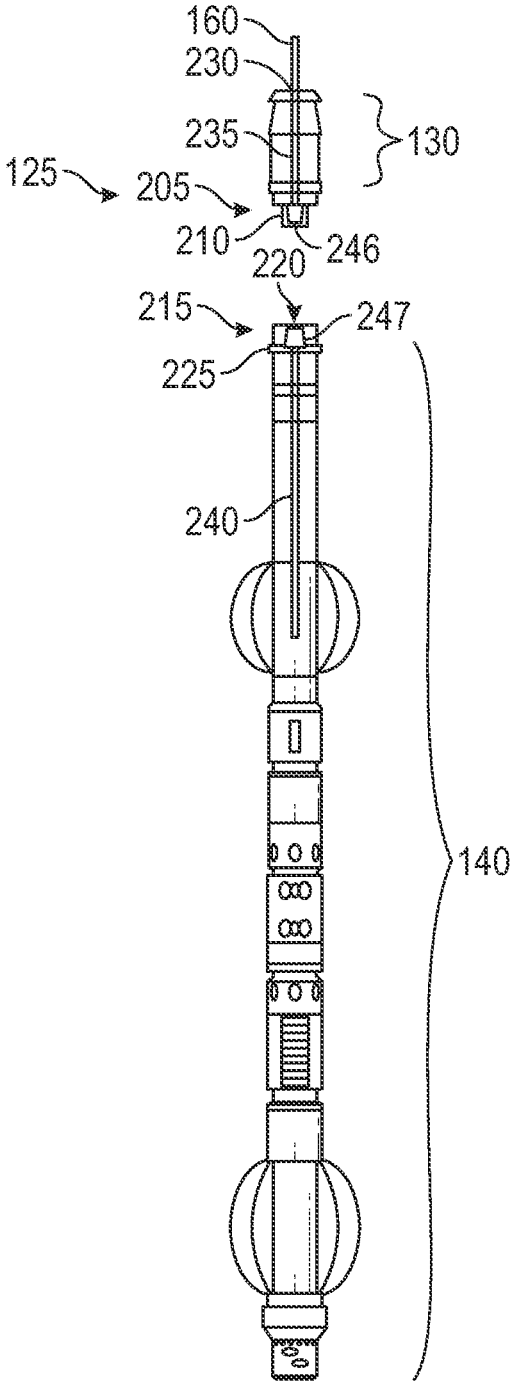

Turning to FIG. 2B, release sub 135 is shown with first portion 205 decoupled from second portion 215, and electrical coupler 245 decoupled leaving an upper coupling 246 severed from a lower coupling 247. As shown, first portion 205 includes a threaded pin 210 and second portion 215 includes a threaded box 220. When downhole tool 125 is assembled, threaded pin 210 is moved into physical contact with threaded box 220 and an electric motor (not shown) rotates threaded pin 210 causing threaded pin 210 to thread into threaded box 220. As the rotation of threaded pin 210 continues, first portion 205 is brought toward second portion 215 until they are coupled as shown in FIG. 2A. This coupling joins first section 130 to second section 140.

To separate first section 130 from second section 140, the electric motor (not shown) is engaged to rotate threaded pin 210 relative to threaded box 220 in a direction that causes the threads on threaded pin 210 to unthread from the threads in threaded box 220. As threaded pin 210 is rotated by the electric motor relative to threaded box 220, first portion 205 moves farther from second portion 215 until first portion 205 disconnects from second portion 215.

As first portion 205 separates from second portion 215, electrical coupler 245 also disconnects leaving upper coupling 246 severed from lower coupling 247. In some embodiments, this decoupling of electrical coupler 245 is caused by wireline 160 pulling first section 130 away from second section 140. Based upon the disclosure provided herein, one of ordinary skill in the art will recognize other processes that may be used in relation to different embodiments to sever electrical coupler 245 including, but not limited to, rotating upper coupling 246 along with threaded pin 210.

With first section 130 pulled away from second section 140, fish neck 225 is exposed. Such a clear fish neck 225 provides a good attachment location that may be used for attaching when an attempt is made to retrieve second section 140 from wellbore 150. Any of a number of processes known in the art for fishing a device disposed in a wellbore may be performed using fish neck 225 to retrieve second section 140. Such may include, but are not limited to, lowering a rope or cord into wellbore 150 such that it catches fish neck 225. The rope or cord may then be pulled to retrieve second portion 140 of downhole tool 125.

Figure 3A:
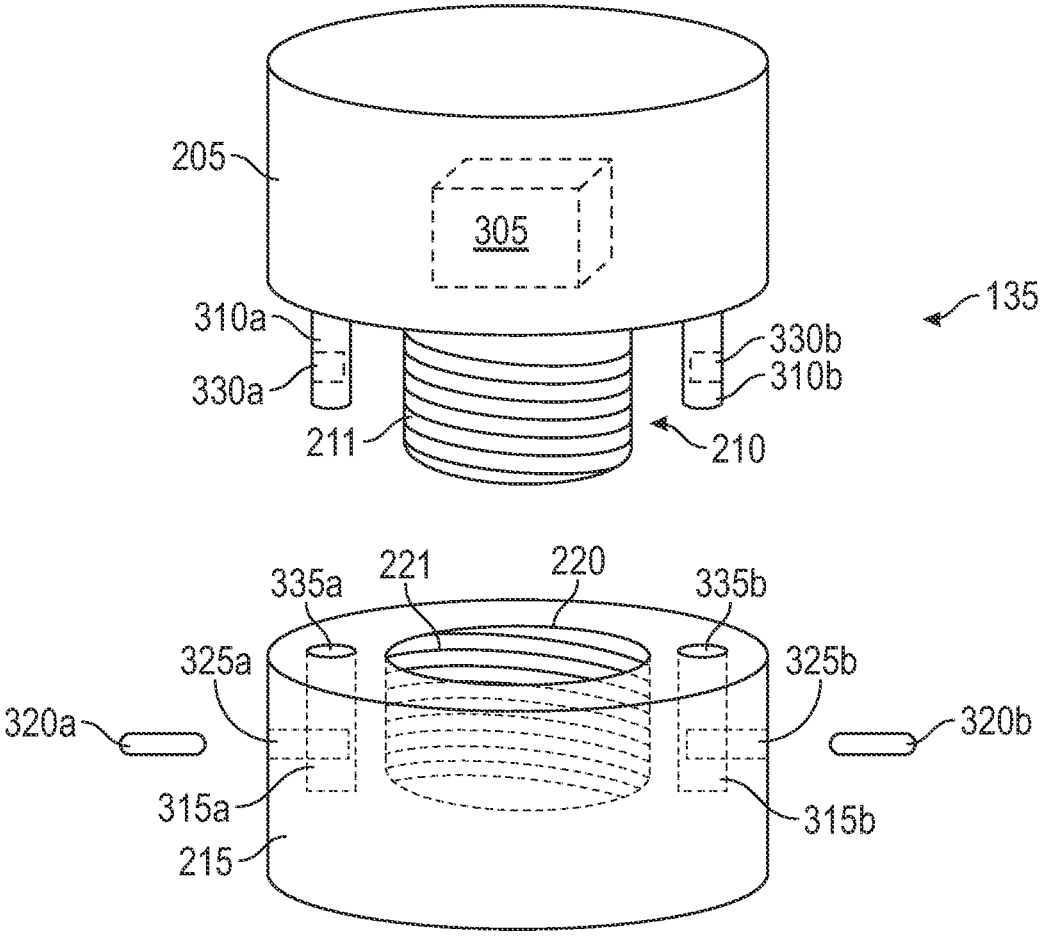
FIGS. 3A-3B show a detailed view of a release sub in accordance with some embodiments.

Turning to FIG. 3A, a side view of release sub 135 is shown in accordance with some embodiments with various internal openings and threads shown in dashed lines. As shown threaded pin 210 includes threads 211 that match threads 221 in threaded box 220. An electric motor 305 is disposed within first portion 205 of release sub 135. Electric motor 305 is mechanically coupled to threaded pin 210 and is capable of rotating threaded pin 210 in one rotational direction to engage the threads of threaded box 220 and in the opposite rotational direction to disengage. One of ordinary skill in the art will recognize bearings and other elements that may be used in relation to the combination of electric motor 305 and threaded pin 210 to facilitate the rotation of threaded pin 210 relative to other parts of portion 205 of release sub 135.

An alignment pin 310*a* extends away from first portion 205 and mates with an alignment socket 315*a* extending into second portion 215 of release sub 135. Similarly, an alignment pin 310*b* extends away from first portion 205 and mates with an alignment socket 315*b* extending into second portion 215 of release sub 135. When first portion 205 is brought together with second portion 215 and threaded pin 210 is rotated by electric motor 305 to engage the threads of threaded box 220, alignment pin 310*a* slides into an opening 335*a* of alignment socket 315*a* and alignment pin 310*b* slides into an opening 335*b* of alignment socket 315*b*.

Alignment pin 310*a* includes a first shear pin opening 330*a* extending into alignment pin 310*a* that is of a size sufficient to accommodate a shear pin 320*a*. Similarly, alignment pin 310*b* includes a first shear pin opening 330*b* extending into alignment pin 310*b* that is of a size sufficient to accommodate a shear pin 320*b*. When first portion 205 is brought together with second portion 215 and threaded pin 210 is rotated by electric motor 305 to engage the threads of threaded box 220, alignment pin 310*a* slides into alignment socket 315*a* until first shear pin opening 330*a* aligns with a second shear pin opening 325*a* extending into second portion 215. Similarly, first shear pin opening 330*b* aligns with a second shear pin opening 325*b* extending into second portion 215. With first shear pin openings 330 aligned with second shear pin openings 325, shear pin 320*a* is inserted such that it extends at least partially into both first shear pin opening 330*a* and second shear pin opening 325*a*; and shear pin 320*b* is inserted such that it extends at least partially into both first shear pin opening 330*b* and second shear pin opening 325*b*. In addition to threading threaded pin 210 into threaded box 220, insertion of shear pins 320 secures first portion 205 to second portion 215.

Figure 4A:
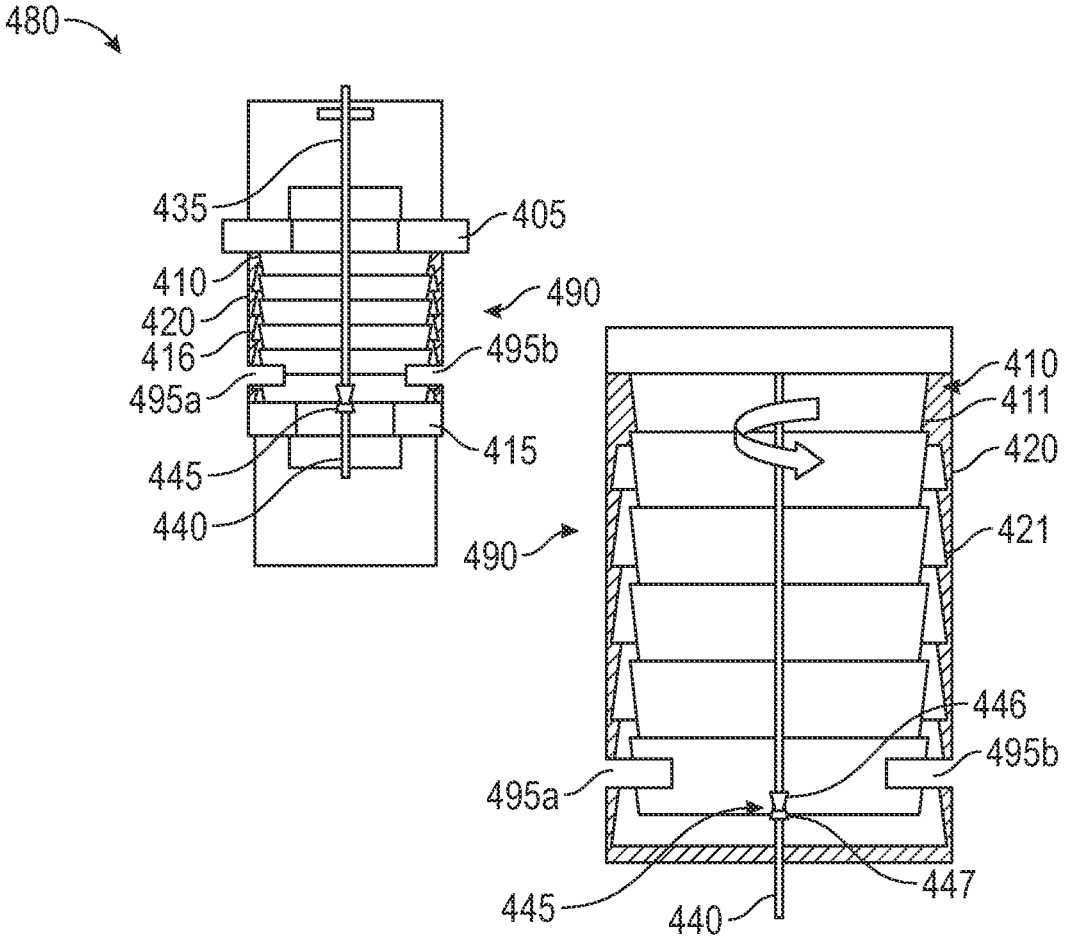
FIGS. 4A-4B show a release sub having shear pins that extend through the threads of a threaded pin and a threaded box in accordance with various embodiments.
Figure 4B:
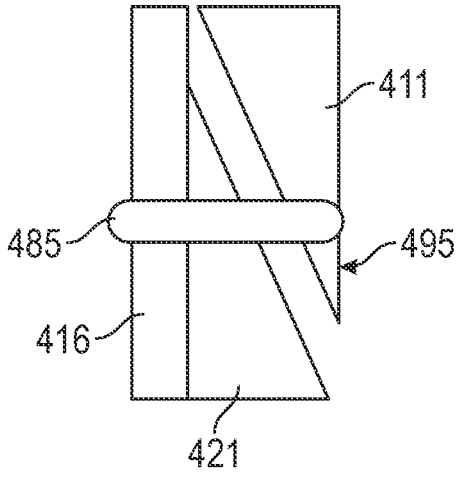

FIG. 3A shows one embodiment where first shear pin openings 330 extend only partially through the respective alignment pins 310. In other embodiments, first shear pin openings 330 extend completely through the respective alignment pins 310 such that shear pins 320 can be inserted through the combination of first shear pin opening 330 and second shear pin opening 325 and touch the wall of the respective alignment socket 315. In yet other embodiments, second shear pin opening 325 extends through the second portion 215 and into threaded box 220. An example of shear pins extending into a threaded pin is shown in FIGS. 4A-4B. In such an embodiment, shear pins 320 are inserted such that they extend through a respective one of alignment pins 310 and into the threads of threaded pin 210. In such embodiments, alignment pins 310 may or may not be included. Insertion of shear pin 320 into the threads of threaded pin 320 further limits the rotational ability of threaded pin 210.

Figure 3B:
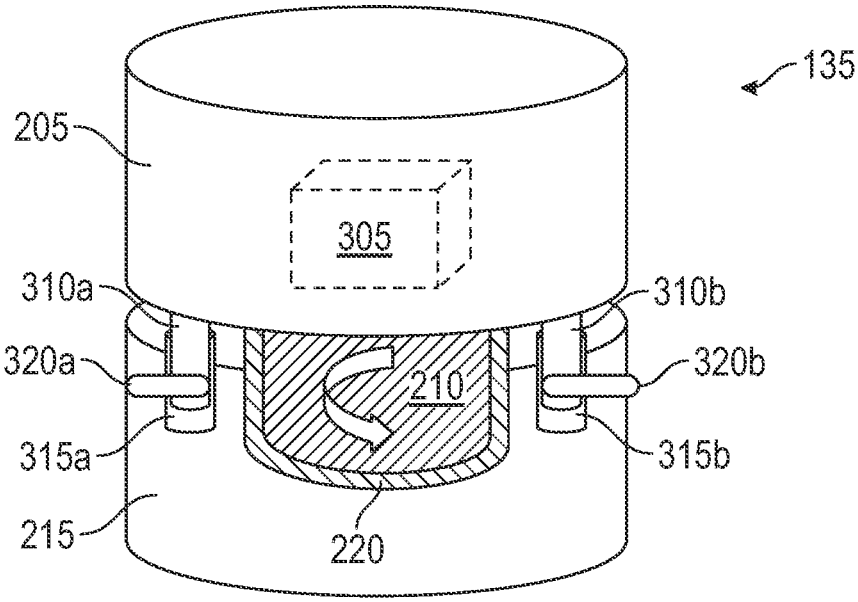

Turning to FIG. 3B, a cut away view of release sub 135 is shown after threaded pin 210 is threaded into threaded box 220, and shear pins 320 are inserted into respective pairs of first shear pin opening 330 and second shear pin opening 325. Alignment pins 310 inserted into alignment sockets 315 limit the possibility of first portion 205 rotating relative to second portion 215. Further, with shear pins 320 inserted the possibility of first portion 205 being pulled away from second portion 215 is limited. An arrow shows a direction of rotation to engage the threads of threaded pin 210 with the threads of threaded box 220.

While the embodiment of FIGS. 3A-3B shows two alignment pins 310 disposed on opposite sides of threaded pin 210 and corresponding alignment sockets 315 disposed on opposite sides of threaded box 220, other embodiments may have more or fewer combinations of alignment pins and alignment sockets. Further, the combination of alignment pins and alignment sockets may be disposed in a variety of locations relative to the threaded pin and threaded box. For example, alignment pins may extend from second portion 215, and corresponding alignment sockets may extend into first portion 205. As another example, a first alignment pin may extend from first portion 205 and a second alignment pin may extend from second portion 215, each with a corresponding alignment socket in the opposite portion of release sub 135.

In some embodiments, hammering by hydraulic jar 270 on release sub 135 causes sufficient movement of each of alignment pins 310 relative to its corresponding alignment socket 315 to cause shearing of shear pins 320. The transfer of the jarring force from hydraulic jar 270 to movement of alignment pins 310 relative to alignment sockets 315 is facilitated by a combination of an imprecise match between threads 211 of threaded pin 210 and threads 221 of threaded box 220, and flexibility of an outer edge of first portion 205 relative to a center point of first portion 205. In some embodiments when first portion 205 is to be separated from second portion 215, hydraulic jar 270 which is disposed next to release sub 135 is activated to cause one or more hammering actions at an upper edge of first portion 205. This hammering action results in movement of each of alignment pins 310 relative to its corresponding alignment socket 315. The hammering force is greater than that required to break shear pins 320. After shear pins 320 are sheared, electric motor 305 is actuated to rotate threaded pin 210 in a direction that causes it to disengage from threads 221 of threaded box 220. This rotation is continued until threaded pin 210 is removed from threaded box 220.

Electric motor 305 is electrically coupled to first conductor portion 235 that receives electrical current from wireline 160. As described above in relation to FIGS. 2A-2B, electrical coupler 245 electrically couples first conductor portion 235 to second conductor portion 240. While not shown in FIGS. 3A-3B, first conductor portion 235 and second conductor portion 240 extend through release sub 135 as shown in FIGS. 2A-2B. In some embodiments, electrical coupler 245 is disposed in threaded pin 210. In such embodiments, disengaging threads 211 of threaded pin 210 from threads 221 of threaded box 220 causes upper coupling 246 of electrical coupler 245 to separate from lower coupling 247 of electrical coupler 245 as discussed above in relation to FIGS. 2A-2B. In some cases, the separation of upper coupling 246 from lower coupling 247 is caused by pulling on wireline 160 after threaded pin 210 is disengaged from threaded box 220. In other cases, the rotation of threaded pin 210 causes the separation of upper coupling 246 from lower coupling 247. Based upon the disclosure provided herein, one of ordinary skill in the art will recognize a variety of approaches that may be used to separate upper coupling 246 from lower coupling 247 in accordance with different embodiments.

Turning to FIG. 4A, an alternate embodiment that may be used in place of release sub 135 is shown where shear pins 485 extend into threads 411 of a threaded pin 410 and threads 421 of a threaded box 420. As shown, release sub 480 includes a first portion 405 and a second portion 415. First portion 405 includes threaded pin 410 and an electric motor (not shown). Second portion 415 includes threaded box 420. Shear pin openings 495 (e.g., a shear pin opening 495*a* and a shear pin opening 495*b*) extend through a body 416 of second portion 415 and partially through threaded pin 410. A mid-section 490 of release sub 480 is enlarged to show greater detail of shear pin openings 495 extending through body 416 of second portion 415 and partially through threaded pin 410. An arrow shows a direction of rotation that engages threads 411 with threads 421.

A first electrical conductor 435 and a second electrical conductor 440 extend through release sub 480. First conductor portion 435 is electrically connected to second conductor portion 440 by an electrical coupler 445. Electrical coupler 445 includes an upper coupling 446 and a lower coupling 447. An electric motor (not shown) included in first portion 405 is electrically coupled to first conductor portion 435 that receives electrical current from wireline 160. In some embodiments, disengaging threads 411 of threaded pin 410 from threads 421 of threaded box 420 causes upper coupling 446 of electrical coupler 445 to separate from lower coupling 447 of electrical coupler 445. In some cases, the separation of upper coupling 446 from lower coupling 447 is caused by pulling on wireline 160 after threaded pin 410 is disengaged from threaded box 420. In other cases, the rotation of threaded pin 410 causes the separation of upper coupling 446 from lower coupling 447. Based upon the disclosure provided herein, one of ordinary skill in the art will recognize a variety of approaches that may be used to separate upper coupling 446 from lower coupling 447 in accordance with different embodiments.

Turning to FIG. 4B, an enlarged view of a shear pin 485 inserted into a shear pin opening 495 is provided. As shown, shear pin 485 extends through body 416 and into threaded pin 410. In this configuration, shear pin 485 stops any rotational movement of threaded pin 410 relative to threaded box 420. The imprecision in the mating of threads 421 to threads 411 allow for sufficient movement to break shear pin 485 when sufficient force is applied (e.g., from hydraulic jar 270) to release sub 480. Once shear pin 485 is sheared, threaded pin 410 is freed to rotate relative to threaded box 420.

While the embodiment of FIGS. 4A-4B does not include alignment pins similar to those discussed above in relation to FIGS. 3A-3B, based upon the disclosure provided herein, one of ordinary skill in the art will recognize that the embodiments could be modified to include one or more alignment pins. In such embodiments, the shear pins may extend both into the threads and into the alignment pin(s). Alternatively, an opening for installing shear pins may extend through the alignment pin(s) and the shear pin(s) are installed through the alignment pins. In such an embodiment, when installed, the shear pin(s) only extend between body 416 of second portion 415 and threaded pin 410.

In some embodiments, hammering by a hydraulic jar (not shown) disposed next to release sub 480 causes sufficient movement of each threaded pin 410 relative to threaded box 420 to cause shearing of shear pin(s) 485. The hydraulic jar is actuated by pulling on wireline 160 with a force that is less than that for which wireline 160 is rated. The hammering force applied by the hydraulic jar on release sub 480 is greater than that required to break shear pin(s) 485. After shear pins 485 are sheared, the electric motor of first portion 405 is actuated to rotate threaded pin 410 in a direction that causes it to disengage from threads 421 of threaded box 420. This rotation is continued until threaded pin 410 is removed from threaded box 420.

Figure 5:
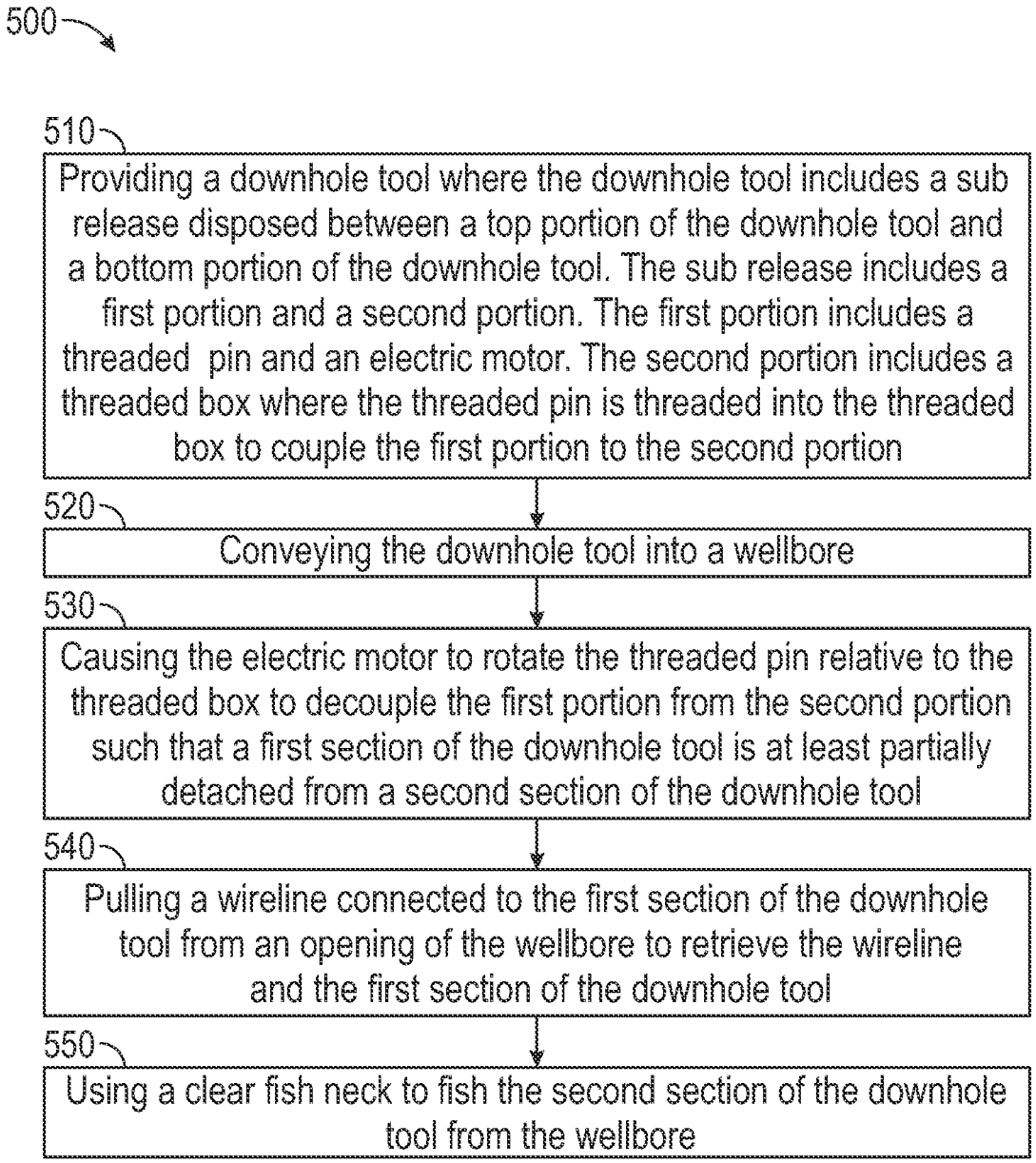
FIG. 5 is a flow diagram showing a method in accordance with some embodiments.

Turning to FIG. 5, a flow diagram 500 shows a method in accordance with some embodiments. Following flow diagram 500, a downhole tool is provided (block 510). The downhole tool includes a release sub disposed between a first section of the downhole tool and a second section of the downhole tool. The release sub includes: a first portion having a threaded pin and an electric motor, and a second portion having a threaded box (220). The threaded pin is threaded into the threaded box to couple the first portion to the second portion.

The method further includes conveying the downhole tool into a wellbore (block 520); and causing the electric motor to rotate the threaded pin relative to the threaded box to decouple the first portion from the second portion (block 530). Such decoupling of the first portion from the second portion at least partially detaches the first section of the downhole tool from the second section of the downhole tool.

The method further includes pulling a wireline connected to the first section of the downhole tool (block 540). Pulling the wireline retrieves the first section of the downhole tool and the wireline. The method further includes using a fish neck exposed on the second section of the downhole tool to fish the second section from the wellbore (block 550).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method, comprising:

conveying a downhole tool into a wellbore, wherein the downhole tool includes:

a release sub disposed between a first section of the downhole tool and a second section of the downhole tool, wherein the release sub includes:

a first portion including:

a threaded pin;

an electric motor;

a second portion including a threaded box, wherein the threaded pin is threaded into the threaded box to couple the first portion to the second portion, wherein the first section of the downhole tool includes a connector connected to a wireline extending from an opening of the wellbore to the downhole tool, wherein the second section of the downhole tool includes a fish neck;

causing the electric motor to rotate the threaded pin relative to the threaded box to decouple the first portion from the second portion, wherein the first section of the downhole tool is at least partially detached from the second section of the downhole tool;

pulling the wireline from the opening of the wellbore to retrieve the wireline and the first section of the downhole tool; and using the fish neck to fish the second section of the downhole tool from the wellbore.

2. The method of claim 1, wherein causing the electric motor to rotate the threaded pin relative to the threaded box includes:

applying an electric current to a conductor via the wireline, wherein the conductor is electrically coupled to the electric motor and one or more tools included in the second section of the downhole tool.

3. The method of claim 2, wherein the conductor includes a first conductor portion attached to a second conductor portion by an electrical coupler included within the release sub, and wherein the method further comprises:

uncoupling the electrical coupler to detach the first conductor portion from the second conductor portion.

4. The method of claim 1, wherein the first portion further includes a first shear pin opening and the second portion further includes a second shear pin opening, and wherein the downhole tool further includes:

a shear pin extending into both the first shear pin opening and the second shear pin opening to secure the first portion to the second portion.

5. The method of claim 4, wherein the first section of the downhole tool includes a connector, and a hydraulic jar disposed between the connector and the release sub, the method further comprising:

actuating the hydraulic jar to apply a force on the release sub sufficient to shear the shear pin.

6. The method of claim 5, wherein the force is a first force, and wherein:

deploying the downhole tool includes connecting a wireline to the connector; and actuating the hydraulic jar includes applying a second force to the connector by pulling the wireline, wherein the second force is less than the first force.

7. The method of claim 6, wherein the wireline is rated to withstand a third force before breaking, and wherein the third force is greater than the second force.

8. The method of claim 4, wherein the first portion includes an alignment pin, wherein the second portion includes an alignment socket configured to receive the alignment pin, and wherein the first shear pin opening extends into the alignment pin.

9. The method of claim 8, wherein the first shear pin opening includes an alignment opening extending through the alignment pin and a threaded pin opening extending into the threaded pin, and wherein the shear pin extends into both the alignment opening and the threaded pin opening to stop the threaded pin from rotating.

10. The method of claim 4, wherein the second portion includes an alignment pin, wherein the first portion includes an alignment socket configured to receive the alignment pin, and wherein the second shear pin opening extends into the alignment pin.

11. A downhole tool device, the downhole tool device comprising:

a release sub attachable between a first section of a downhole tool and a second section of the downhole tool, and configured to detach the first section of the downhole tool from the second section of the downhole tool, the release sub including:

a first portion including:

a threaded pin;

an electric motor configured to rotate the threaded pin; and a first shear pin opening;

a second portion including:

a threaded box; and a second shear pin opening, wherein the threaded pin is securable to the threaded box by rotating the threaded pin relative to the threaded box, and wherein the downhole tool comprises a shear pin extending into both the first shear pin opening and the second shear pin opening to secure the first portion to the second portion.

12. The downhole tool of claim 11, wherein the first section of the downhole tool includes:

a connector; and a hydraulic jar disposed between the connector and the release sub, wherein the hydraulic jar is configured to apply a force on the release sub when actuated, and wherein the force is sufficient to shear the shear pin.

13. The downhole tool of claim 12, wherein a wireline is connected to the connector, wherein the force is a first force, wherein the hydraulic jar is actuated by applying a second force by pulling the wireline away from the connector, and wherein the second force is less than the first force.

14. The downhole tool of claim 13, wherein the wireline is rated to withstand a third force before breaking, and wherein the third force is greater than the second force.

15. The downhole tool of claim 11, wherein the first portion includes an alignment pin, wherein the second portion includes an alignment socket configured to receive the alignment pin, and wherein the first shear pin opening extends into the alignment pin.

16. The downhole tool of claim 15, wherein the first shear pin opening includes an alignment opening extending through the alignment pin and a threaded pin opening extending into the threaded pin, and wherein the shear pin extends into both the alignment opening and the threaded pin opening to stop the threaded pin from rotating.

17. The downhole tool of claim 11, wherein the second portion includes an alignment pin, wherein the first portion includes an alignment socket configured to receive the alignment pin, and wherein the second shear pin opening extends into the alignment pin.

18. The downhole tool of claim 13, wherein the downhole tool further includes:

a measurement tool disposed below the release sub, wherein both the measurement tool and the electric motor are electrically connected to a conductor extending from the wireline through the first section of the downhole tool, the release sub, and the second section of the downhole tool.

* * * * *